US006224002B1

(12) United States Patent
Reiter

(10) Patent No.: US 6,224,002 B1
(45) Date of Patent: May 1, 2001

(54) FUEL INJECTION VALVE

(75) Inventor: Ferdinand Reiter, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/230,900

(22) PCT Filed: Feb. 20, 1998

(86) PCT No.: PCT/DE98/00506

§ 371 Date: Feb. 3, 1999

§ 102(e) Date: Feb. 3, 1999

(87) PCT Pub. No.: WO98/55763

PCT Pub. Date: Dec. 10, 1998

(30) Foreign Application Priority Data

Jun. 6, 1997 (DE) ..... 197 23 953

(51) Int. Cl.[7] ..... F02M 51/00

(52) U.S. Cl. ..... 239/585.3; 239/585.1; 239/533.9; 239/533.12

(58) Field of Search ..... 239/585.1, 585.2, 239/585.3, 533.9, 533.2, 533.3, 533.12

(56) References Cited

U.S. PATENT DOCUMENTS

| | | | | |
|---|---|---|---|---|
| 1,879,985 | * | 9/1932 | Lummen | 239/533.3 |
| 2,756,107 | * | 7/1956 | Korda | 239/533.2 |
| 3,008,653 | * | 11/1961 | Morris et al. | 239/533.12 |
| 3,542,293 | * | 11/1970 | Bishop et al. | 239/533.12 |
| 4,057,190 | | 11/1977 | Kiwior et al. . | |
| 4,266,729 | * | 5/1981 | Kulke et al. | 239/533.12 |
| 4,354,640 | * | 10/1982 | Hans | 239/533.9 |
| 4,394,973 | * | 7/1983 | Sauer et al. | 239/585.2 |
| 4,421,278 | * | 12/1983 | Kienzle et al. | 239/533.12 |
| 4,917,307 | * | 4/1990 | Baxter et al. | 239/533.2 |
| 4,971,254 | * | 11/1990 | Daly et al. | 239/533.12 |
| 5,192,048 | * | 3/1993 | Wakeman | 239/585.3 |
| 5,242,117 | * | 9/1993 | D'Agostino et al. | 239/533.2 |
| 5,261,639 | | 11/1993 | Bantien et al. . | |
| 5,626,292 | * | 5/1997 | Armaroli et al. | 239/585.1 |
| 5,881,957 | * | 3/1999 | Mizuno et al. | 239/533.9 |
| 5,997,507 | * | 12/1999 | Dysarz | 604/161 |

FOREIGN PATENT DOCUMENTS

| | | | |
|---|---|---|---|
| 25 08 390 | | 9/1976 | (DE) . |
| 34 27 526 | | 2/1986 | (DE) . |
| 35 35 438 | | 4/1987 | (DE) . |
| 0 354 659 | | 2/1990 | (EP) . |
| 334083 | * | 8/1930 | (GB) ..... 239/833.9 |

* cited by examiner

*Primary Examiner*—David A. Scherbel
*Assistant Examiner*—Christopher S. Kim
(74) *Attorney, Agent, or Firm*—Kenyon & Kenyon

(57) ABSTRACT

A fuel injection valve for fuel injection systems of internal combustion engines, includes components that can be manufactured in an inexpensive and simple manner. The valve needle movable along a longitudinal valve axis is formed by a thin wire, which represents the downstream elongated extension of a helical restoring spring. The valve needle engages in a sealing element, which is coupled to a valve seat body having a fixed valve seat. The valve needle and the sealing element are arranged with respect to the valve seat so that the wire transmits pressure forces to the sealing element in the closed position. The fuel injection valve is suited for use in fuel injection systems of compressed mixture, externally ignited internal combustion engines.

12 Claims, 2 Drawing Sheets

FUEL INJECTION VALVE

BACKGROUND INFORMATION

German Patent Application No. 25 08 390 describes a fuel injection valve having an axially movable valve needle designed as a thin rigid rod or as a non-rigid wire. The downstream end of the rod is connected by friction to a closing head, which works together with a valve seat. On its opposite end, the rod runs through an armature and is connected to a tension spring upstream from the armature. The tension spring is responsible for the closing head being drawn to the valve seat via the rod when the magnet coil is not energized, so that the valve is in the closed position. If the magnet coil is energized, it attracts the armature, and the tension spring is extended. As a result, the rod moves axially so that the closing head rises from the valve seat. The tensile forces of the tension spring cause the valve to reclose when the magnet coil is not energized.

German Patent Application Nos. 34 27 526 and 35 35 438 describe electromagnetically actuated fuel injection valves having a flat armature in their magnetic circuit, German Patent Application No. 34 27 526 also describes a light and elongated valve needle.

SUMMARY OF THE INVENTION

The fuel injection valve according to the present invention has the advantage that it can be manufactured with simple and inexpensive components. The valve needle is designed as a thin wire, connected to a sealing element, and the sealing element is in turn coupled to a valve seat. It is advantageous that the valve needle and the sealing element may be designed so that the wire transfers pressure forces to the sealing element and the valve seat in the closed valve position, i.e., when the sealing element is in contact with the valve seat.

It is advantageous to design the wire used as a valve needle in one piece as an elongated downstream extension of a helical restoring spring, the elastic force of which brings the sealing element into the closed valve position through the valve needle. In order to increase the flexural strength of the thin wire, the valve needle is advantageously provided with a support element, which can be manufactured in a simple manner. A very high degree of flexural strength is achieved with minimum additional weight through an L-shaped sheet metal angle partially surrounding the elastic wire located in the bend of the sheet metal angle. The two legs of the support element prevent the sheet metal angle from slipping on the wire.

It is also advantageous for a non-positive bond to be between the wire and the sealing element. The wire, rounded on its downstream end, engages in a depression of the sealing element and thus transfers the pressure forces of the restoring spring to the sealing element. It is advantageous if the depression has a conical shape with the bottom of the depression ideally having the same diameter as the rounded wire end.

In addition, it is advantageous if an armature of the electromagnetic circuit is designed as a flat armature, which supports the restoring spring. Due to its small height, a flat armature design is particularly recommended- The design of a flat armature allows a non-magnetic, for example, austenitic, material to be used for a valve seat support, which can be deep-drawn much better than a ferritic material, resulting in lower production costs.

With the fuel injection valve according to the present invention, injection points can be preset to a considerable degree (e.g., as early as in the intake pipe) in a simple manner (extended tip injector), since the lengths of the deep-drawn valve seat support and the elastic wire can be easily and inexpensively varied. It is of great advantage that in the above-mentioned design of the valve needle the preset injection point can be achieved with a very small moving mass.

In order to guarantee that the injection valve opens when the magnet coil is energized, an elastic corrugated disk is arranged between the sealing element and a valve seat body which features the valve seat and is coupled to the sealing element; the elastic force of the corrugated disk opposes the elastic force of the restoring spring. Thus the sealing element is raised from the valve seat by the corrugated disk. The corrugated disk advantageously has bore holes, slots, or grooves to allow the fuel to flow in the direction of the valve seat. In addition, the corrugated disk is responsible for the radial guidance of the sealing element in the valve seat support.

The valve seat body may also have a conical orifice, in which an at least partially conical self-centering perforated disk can be inserted. Thus expensive centering devices are not required for the assembly of the perforated disk.

The design of the armature and the valve seat body as a flat armature and a flat seat allows relatively great guidance tolerances, which reduces manufacturing costs.

These above-mentioned overall design features, making welding operations on the sealing element and the valve seat body unnecessary, allow ceramic to be used for these two components, for example, when aggressive fuels are used.

DETAILED DESCRIPTION

Figure 1:
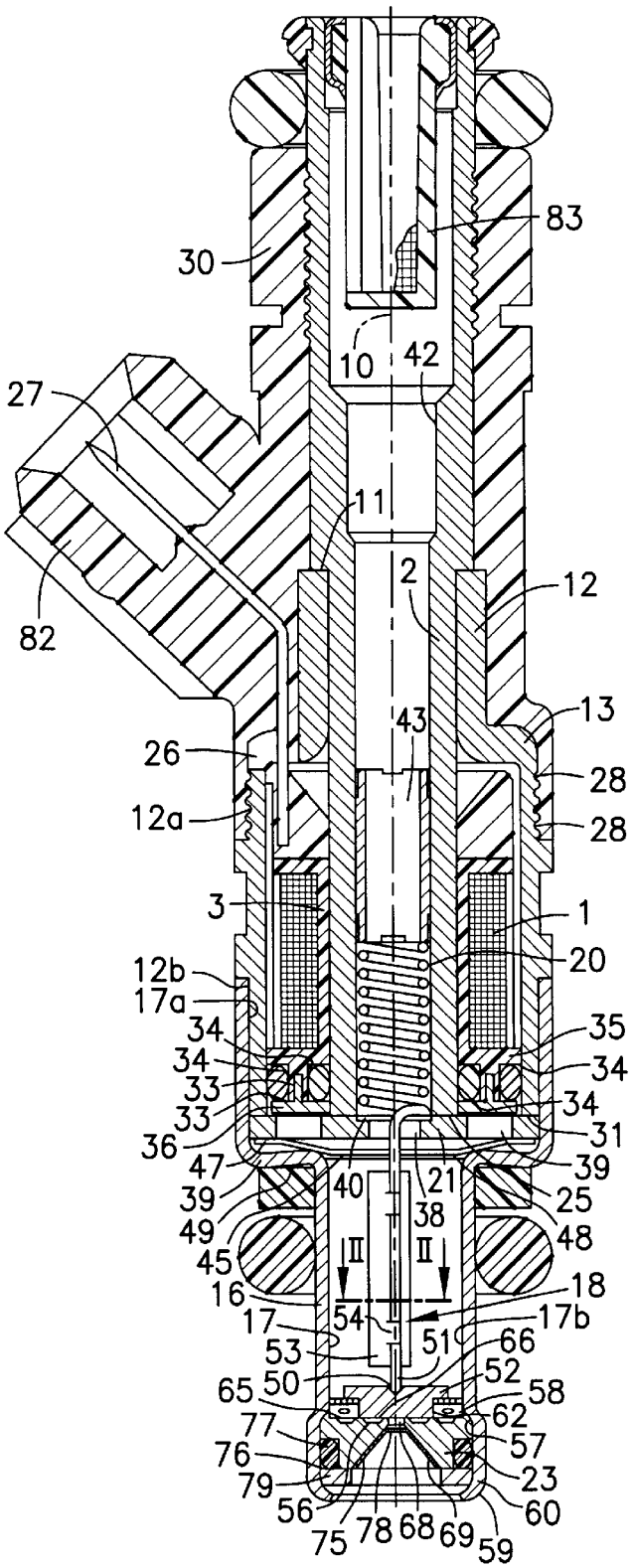
FIG. 1 shows a fuel injection valve with a valve needle according to an exemplary embodiment of the present invention.

An exemplary electromagnetically actuated valve in the form of an injection valve for fuel injection systems for compressed-mixture, externally ignited internal combustion engines, illustrated in FIG. 1, has a tubular core 2 serving as a fuel inlet fitting, surrounded by a magnet coil 1; The tubular core has stepped inner and outer diameters over its axial length, for example. A bobbin 3 made of plastic receives a winding of magnet coil 1 and allows, in conjunction with core 2, a compact design of the injection valve in the area of magnet coil 1.

Core 2, concentric with a longitudinal valve axis 10, has, in the central area of its axial length, a shoulder 11 on its external contour; on this shoulder, core 2 is connected to a metallic valve jacket 12 by laser welding, for example. Valve jacket 12 has a stepped design, so that it extends radially outward above magnet coil 1 from core 2 with an area 13, and then surrounds magnet coil 1 from the outside, viewed in the downstream direction. Thus magnet coil 1 is embedded between core 2 and valve jacket 12. In the downstream direction, a sleeve-like valve seat support 16, which may be stepped, follows valve jacket 12 and is permanently connected to it. A longitudinal orifice 17 runs in valve seat support 16 concentrically with longitudinal valve axis 10. While an upper area 17*a* of longitudinal orifice 17 is sufficiently wide to surround, at least partially, valve jacket 12, a lower area 17*b* of longitudinal orifice 17 has a smaller diameter. A valve needle 18 is arranged mainly in lower area 17*b* of longitudinal orifice 17.

The injection valve is actuated in a conventional manner, for example, electromagnetically. Electromagnetic circuit with magnet coil 1, core 2, valve jacket 12, and armature 21 are used to move valve needle 18 axially, and thus to open the valve against the elastic force of a restoring spring 20 and to close the injection valve. Armature 21 is designed in the shape of a flat armature, connected with its upstream end to valve needle 18 and aligned with core 2. A cylindrical valve seat body 23 having a fixed valve seat is mounted in longitudinal orifice 17 at the downstream end of valve seat support 16 that faces away from core 2.

Core 2, used as an inlet fitting for fuel and a stop for armature 21, has, in the downstream direction from shoulder 11, a smaller outer diameter than it does upstream from shoulder 11, whereby the injection valve also has a relatively small outer diameter in the area of magnet coil 1. Core 2 is either a turned part or a deep-drawn ferritic tube. A bottom stop surface 25, facing armature 21, is chrome-plated or chemically nickel plated, for example. Valve jacket 12, resembling a guide cup, is a deep-drawn ferromagnetic component. In its radial area 13 above magnet coil 1, valve jacket 12 has a recess 26, through which contact rods 27, exiting magnet coil 1, are guided. Valve jacket 12 has, on its external contour, below area 13, specially designed sections, for example —a top section 12*a*, which has grooves 28 running in the circumferential direction to provide positive connection with an extruded plastic part 30, and a bottom section 12*b*, with a depression to fit valve seat support 16. A bottom pole surface 31 of valve jacket 12 is also chrome-plated or chemically nickel-plated like stop surface 25; both surfaces 25 and 31 are situated in one plane, for example.

Bobbin 3 is responsible for dissipating heat and protecting the winding of magnet coil 1 from damage. Two ring projections extend from bobbin 3 in the direction of armature 21, so that three annular chambers 34 are formed between the two ring projections 33 proper and between the internal ring projection 33 and core 2, and the external ring projection 33 and valve jacket 12. A seal ring 35, designed as an o-ring, for example, is placed in each of the internal and external annular chambers 34. With this measure, it is achieved that magnet coil 1 remains dry. Seal rings 35 are axially secured by arranging a supporting ring 36 having a T-shaped cross section between magnet coil 1 and armature 21; an axial arm extends into central annular chamber 34 between the two ring projections 33. The radial arms of supporting ring 36 press against seal rings 35.

Armature 21, designed as a flat armature, is a thin, circular disk, stamped from a larger sheet, for example. A central through hole 38 serves to let the fuel flowing from core 2 in the direction of the valve seat through, and to guide an elastic wire 51 of valve needle 18. Outside central through hole 38, additional holes 39 are provided in armature 21 to achieve a reduction in splash losses due to the flow resistance in the armature area, which would otherwise be too high. Through hole 38 has an embossed recess 40 on the upstream side of armature 21; this recess supports restoring spring 20. Like stop surface 25 and pole surface 31, the upstream face of armature 21 opposite these surfaces is surface coated, for example, chrome-plated or nickel-plated, to provide sufficient wear protection. Valve seat support 16 is precision fabricated with its internal longitudinal orifice 17 so that its upper area 17*a* provides radial guidance for armature 21.

An adjustment sleeve 43, inserted in a flow bore 42 of core 2, concentric with longitudinal valve axis 10, is used for adjusting the elastic pre-tension of restoring spring 20 in contact with adjustment sleeve 43; restoring spring 20 is supported by recess 40 of armature 21 on its opposite side.

Downstream from armature 21, a disk spring 45 is arranged in the longitudinal orifice 17 of valve seat support 16; the disk spring holds armature 21 in its initial position when the armature is not energized, and has an elastic force action against restoring spring 20. Disk spring 45, manufactured by stamping and bending, for example, is provided with a circular outer ring 47 and a circular inner ring 48. Both rings 47 and 48 are connected to each other through a plurality of spokes, arranged over 360°. When magnet coil 1 is energized, disk spring 45 supports the closing motion of armature 21 against the elastic force of restoring spring 20. In addition, disk spring 45 prevents armature 21 from wobbling. In addition to guiding armature 21, valve seat support 16 provides, with its upper area 17*a*, radial guidance for disk spring 45. While the slightly convex outer ring 47 is supported by the bottom face of armature 21, outside holes 39, inner ring 48 of disk spring 45 is in contact with a radial shoulder 49, running radially between areas 17*a* and 17*b*, of valve seat support 16. The inner bend radius, facing longitudinal valve axis 10, between shoulder 49 and bottom area 17*b*, is well suited as a contact area, for example.

Wire 51, in particular elastic wire, serving as valve needle 18, represents the single-piece extension of restoring spring 20, for example, running in a spiral shape to recess 40 of armature 21 and axially straight from there in the downstream direction. On its downstream end, valve needle 18 is rounded, for example, in order to engage in a central, for example, conical, depression 50 of sealing element 52. Valve needle 18 transmits the elastic force (pressure force) of restoring spring 20 to sealing element 52. The disk-shaped sealing element 52 is coupled to valve seat body 23 and forms a seat valve.

Figure 2:
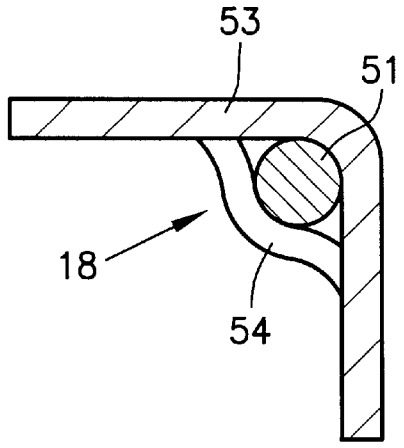
FIG. 2 shows a section along a line II—II in FIG. 1.

To protect the very thin elastic wire 51 from bending, valve needle 18 has an additional, angled support element 53, having an L-shaped cross section. Support element 53 is a sheet bent in a simple manner, surrounding elastic wire 51, in an approximately right angle, over the greater part of the axial extension of valve needle 18 As FIG. 2 shows as a section along line II—II in FIG. 1, elastic wire 51 is stabilized, for example, by providing it with connecting brackets 54 engaging in the bend of support element 53 and connecting the two legs of support element 53. Elastic wire 51 of valve needle 18 can also be permanently connected to support element 53 by welding, soldering, or gluing. High flexural strength of valve needle 18 is achieved in a simple manner with a support element 53.

Disk-shaped sealing element 52 has, on its bottom face 56 facing valve seat body 23, an outer recess 57, running a full 360°, in which a circular elastic corrugated disk 58 is arranged. Bottom face 56 of sealing element 52, manufactured from stainless steel or ceramic, for example, serving as a sealing side together with valve seat body 23, is precisely machined except in the area of recess 57—lapped, for example. Sealing element 52 is radially guided during its axial movement along longitudinal valve axis 10 via corrugated disk 58 in the area 17*b* of valve seat support 16.

In addition to guiding sealing element 52, corrugated disk 58 has the main function of raising sealing element 52 from valve seat body 23 when magnet coil 1 is energized. When magnet coil 1 is not energized, i.e., the valve is closed, a non-positive bond exists between elastic wire 51 and sealing element 52, as well as between sealing element 52 and valve seat body 23 due to the pressure exerted by restoring spring 20, because the elastic force is transmitted via valve seat 18 to sealing element 52. If magnet coil 1 is energized, armature 21 is drawn against the elastic force of restoring spring 20, valve needle 18 being forced to effect the same axial movement. This movement of valve needle 18 results in elastic wire 51 rising from sealing element 52, while sealing element 52 remains on valve seat body 23. Sealing element 52 follows the movement of valve needle 18 due to corrugated disk 58 having an elastic force acting against the elastic force of restoring spring 20, and the valve opens when armature 21 is attracted. Corrugated disk 58 can advantageously receive and store axial forces. For example, a plurality of orifices, in the form of bore holes, slots, or grooves are provided on corrugated disk 58, through which fuel can flow to valve seat body 23.

Sealing element 52 and valve seat body 23 are made of the same material, for example, of stainless steel or ceramic. Valve seat support 16 has on its bottom side 59 a bulge 60 with a larger inner diameter than in area 17*b*, in which valve seat body 23 is precisely positioned. Valve seat body 23 may be in contact with another oblique surface 62 of bulge 60 serving as a stop. Small depressions are made on the upper face of valve body 23, facing sealing element 52, so that at least two raised areas are formed: an outer support area 65 and an inner sealing area 66. Both areas 65 and 66 represent concentric rings, for example, outer support area 65 serving as a stop for corrugated disk 58, and inner sealing area 66 being directly coupled to bottom face 56 of sealing element 52 as a sealing surface. Sealing area 66 is precision machined, for example, lapped, according to the hermeticity requirements of the valve. A central cylindrical orifice 68 on the top face of valve seat body 23 is followed by an orifice area 69 that widens in the downstream direction in the shape of a truncated cone. The flat armature and flat seat design allow for relatively large guidance tolerances, making manufacturing inexpensive.

Figure 3:
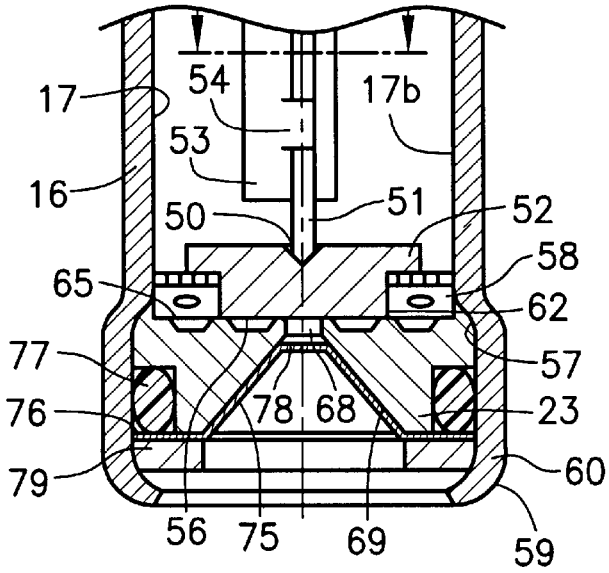
FIG. 3 shows an enlarged view of a downstream end area of the fuel injection valve of FIG. 1.

On its bottom face facing away from sealing element 52, valve seat body 23 is provided with a perforated disk 75, which may be cup-shaped, for example. Perforated disk 75 nestles mainly to the wall of the conical orifice area 69, while it has a circumferential flat holding edge 76 radially outside orifice area 69. In the area of holding edge 76, there is a seal ring 77, for example, between valve seat body 23, bulge 60 of valve seat support 16, and perforated disk 75, to seal the seat area. Immediately downstream from orifice 68, in a largely flat bottom area of perforated disk 75 near longitudinal valve axis 10, at least one, but preferably four, injection orifices 78, formed by erosion or stamping, are provided. The largely conical design within orifice area 69 is advantageous for perforated disk 75 to be self-centering. The cone angle of perforated disk 75 is approximately 2° smaller than the cone angle of orifice area 69 of valve seat body 23. Perforated disk is fastened, for example, using a circular ring-shaped downstream support disk 79, which secures holding edge 76 of perforated disk 75 between itself and valve seat body 23. By providing a bead on end 59 of bulge 60 below support disk 79, perforated disk 75 and support disk 79 are secured in a simple and reliable manner. It is also possible that the cup-shaped perforated disk 75 be connected to valve seat body 23 concentrically and permanently, for example, using a circumferential seal such as a laser welding seam. FIG. 3 shows an enlarged view of a downstream end area of the fuel injection valve of FIG. 1.

Valve seat support 16, which may be deep-drawn, is made of a non-magnetic austenitic material. In area 17*a*, valve seat support 16 is permanently and hermetically connected to valve jacket 12 in the depressed section 12*b*, for example, using a laser welding seam. The depth of insertion of valve seat body 23 determines the pre-setting of the stroke of valve needle 18. The exact adjustment of the stroke is determined by the plastic deformation of radial shoulder 49 of valve seat support 16 in the axial direction. One end position of valve needle 18 when magnet coil 1 is not energized is determined by the contact of sealing element 52 on valve seat body 23, while the other end position of valve needle 18 when magnet coil 1 is energized results from the contact of armature 21 with stop surface 25 of core 2.

Upstream from the coil area, the injection valve is surrounded by extruded plastic jacket 30, which encloses most of core 2 and extends in the axial direction to section 12*a* of valve jacket 12, valve jacket 12 being partially covered in the axial and circumferential directions. An electric connecting plug 82, in which the two contact pins 27 coming from magnet coil 1 and serving to energize magnet coil 1 end, is extruded together with this plastic jacket 30.

On the intake-side end of the injection valve, a fuel filter 83 protrudes into flow bore hole 42 of core 2. The fuel entering the fuel injection valve flows through fuel filter 83 in the known manner and exits fuel filter 83 in the radial direction. Fuel filter 83 is responsible for filtering out particles entrained by the fuel, which due to their size or chemical composition might clog or damage the injection valve.

What is claimed is:

1. A fuel injection valve for a fuel injection system of an internal combustion engine, comprising:

a valve needle including a thin wire and being movable along a longitudinal valve axis of the fuel injection valve;

a valve seat;

an axially movable sealing element cooperating with the valve seat, wherein the fuel injection valve is in a closed position when the axially movable sealing element is in contact with the valve seat, and wherein, in the closed position, the thin wire transmits pressure forces to the axially movable sealing element and the valve seat; and a restoring spring exhibiting an elastic force for holding the axially movable sealing element in contact with the valve seat, wherein the valve needle is formed by the thin wire, the thin wire including an elastic wire which is coupled to the restoring spring as a single piece.

2. The fuel injection valve according to claim 1, wherein the valve needle has a support element for increasing a flexural strength of the thin wire.

3. The fuel injection valve according to claim 2, further comprising:

at least one connecting bracket, wherein the support element includes an L-shaped sheet metal part having a plurality of legs, the legs having a bend portion which cooperates with the at least one connecting bracket for enclosing the thin wire in the bend portion.

4. The fuel injection valve according claims 1, wherein the thin wire is connected to the axially movable sealing element via a non-positive connection.

5. The fuel injection valve according to claim 4, wherein the thin wire has a downstream end portion which has a rounded shape and which engages in a depression of the axially movable sealing element.

6. The fuel injection valve according to claim 5, wherein the depression has a conical shape.

7. The fuel injection valve according to claim 1, further comprising:

a flat armature having a step portion, wherein the restoring spring contacts the step portion of the flat armature.

8. The fuel injection valve according to claim 1, wherein the axially movable sealing element has a disk shape.

9. The fuel injection valve according to claim 8, further comprising:

a valve seat body coupled to the axially movable sealing element and having the valve seat; and an elastic corrugated disk disposed between the axially movable sealing element and the valve seat body, the corrugated disk exerting a force on the axially movable sealing element for lifting the axially movable sealing element from the valve seat to be out of the closed position.

10. The fuel injection valve according to claim 9, wherein at least one of the axially movable sealing element and the valve seat body is composed of a ceramic material.

11. The fuel injection valve according to claim 9, wherein the valve seat body has a conical orifice, and further comprising:

a self-centering perforated disk having, at least partially, a conical design and being insertable into the conical orifice.

12. The fuel injection valve according to claim 11, wherein the self-centering perforated disk is pressed against the valve seat body for securing the self-centering perforated disk in the fuel injection valve.

* * * * *